US005194032A

United States Patent [19]

Garfinkel

[11] Patent Number: 5,194,032

[45] Date of Patent: Mar. 16, 1993

[54] MOBILE TOY WITH ZERO-GRAVITY SYSTEM

[76] Inventor: Henry A. Garfinkel, 31 Dogwood Rd., Searingtown, N.Y. 11507

[21] Appl. No.: 695,467

[22] Filed: May 3, 1991

[51] Int. Cl.[5] ..... A63H 33/40; A63H 17/00; B60B 39/00

[52] U.S. Cl. ..... 446/178; 446/431; 446/435; 180/164; 180/901

[58] Field of Search ..... 180/164, 901; 446/176, 446/177, 178, 179, 201, 217, 218, 135, 136, 236, 433, 445, 454, 455, 456, 457, 470

[56] References Cited

U.S. PATENT DOCUMENTS

| | | | |
|---|---|---|---|
| 3,050,146 | 8/1962 | Crim | 446/179 X |
| 3,189,115 | 6/1965 | Rethorst | 180/116 X |
| 3,208,543 | 9/1965 | Crowley | 180/116 X |
| 3,268,022 | 8/1966 | Gustafson | 180/116 |
| 3,276,529 | 10/1966 | Latimer-Needham | 180/126 |
| 3,747,726 | 7/1973 | Walter | 180/116 X |
| 3,810,515 | 5/1974 | Ingro | 446/433 X |
| 3,887,030 | 6/1975 | Fitzgerald et al. | 180/116 X |
| 4,299,301 | 11/1981 | Janin | 446/437 X |
| 4,718,501 | 1/1988 | Lawler | 180/117 |

FOREIGN PATENT DOCUMENTS

| | | | |
|---|---|---|---|
| 1012940 | 7/1952 | France | 446/437 |
| 0195474 | 11/1984 | Japan | 160/901 |
| 432164 | 7/1935 | United Kingdom | 446/437 |

*Primary Examiner*—David N. Muir

*Attorney, Agent, or Firm*—Dennison, Meserole, Pollack & Scheiner

[57] ABSTRACT

A mobile toy including at least one vacuum generating assembly mounted on a chassis and including an impeller with the axial intake end thereof positionable closely adjacent a support surface whereby at least a major portion of the radial discharge from the impeller flows radially outward and along the support surface to define a fluidic seal about a central zone wherein a negative pressure is maintained. The impeller will preferably mount with a cylindrical sleeve. The mobile device is propelled by driven traction wheels.

25 Claims, 5 Drawing Sheets

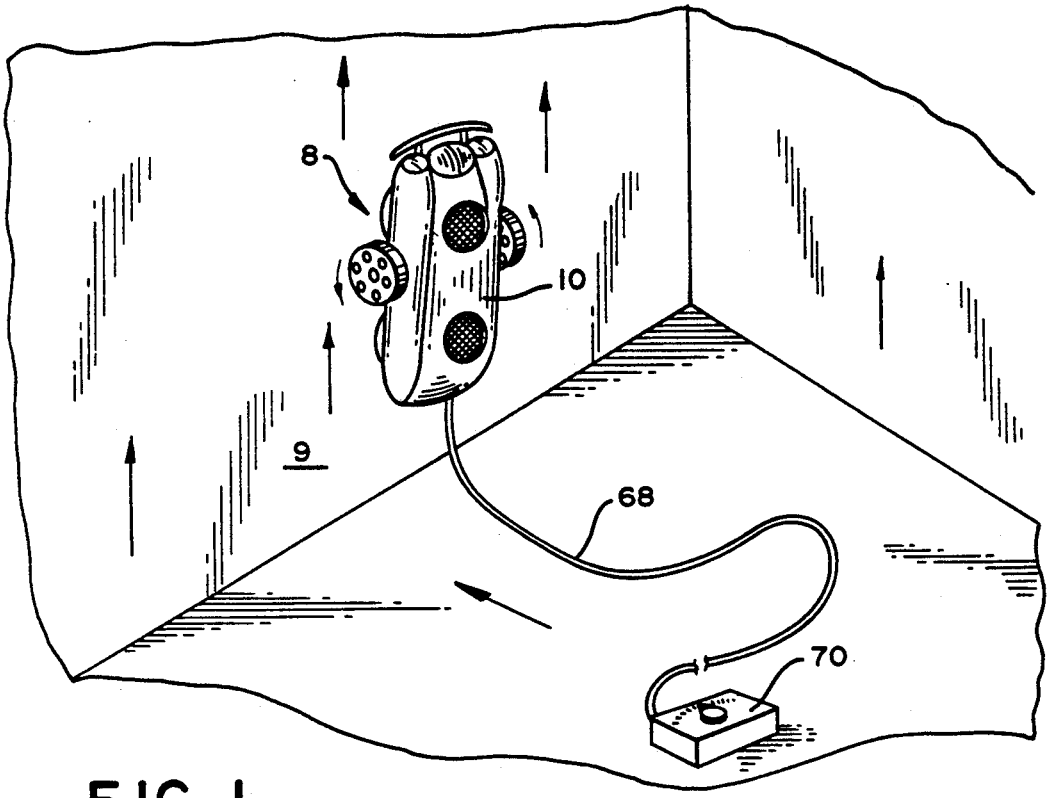
FIG. 1
FIG. 6
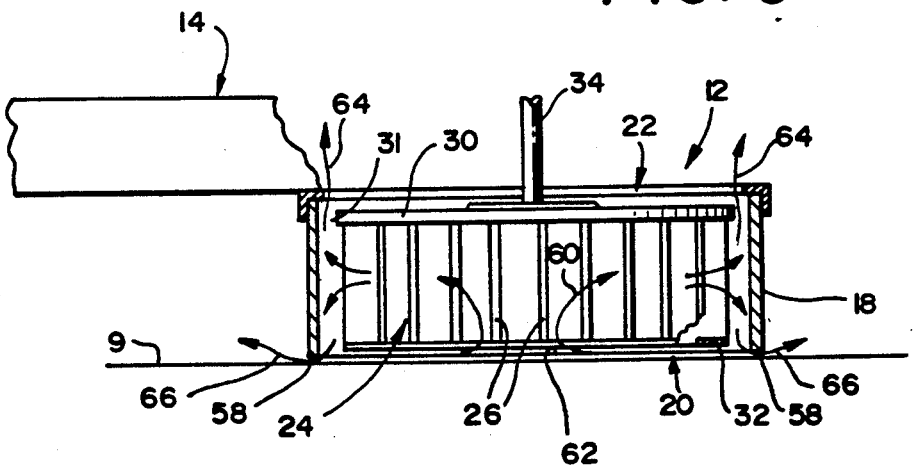

MOBILE TOY WITH ZERO-GRAVITY SYSTEM

BACKGROUND OF THE INVENTION

The invention broadly relates to mobile devices of the type utilizing a negative pressure zone between the device and a support surface to produce a zero-gravity effect whereby the device is retained on the surface regardless of the orientation of the surface.

Such devices, while disclosed in the prior patent art as being utilized for a variety of functions, are more particularly associated with mobile toys, for example toy vehicles or the like, which are intended to climb walls or even travel in an inverted position along ceilings. Examples of known devices will be seen in the following U.S. patents:

U.S. Pat. No. 3,810,515 to Ingro,
U.S. Pat. No. 3,926,277 to Shino et al.,
U.S. Pat. No. 4,664,212 to Nagatsuka et al.,
U.S. Pat. No. 4,926,957 to Urakami,
U.S. Pat. No. 4,971,591 Raviv et al.

Basically, apparatus, normally within the device itself and remote from the support surface, generates a positive air flow perpendicularly away from the surface to create a vacuum or area of negative pressure between the device and the surface whereby the device is retained by ambient pressure which is inherently greater than the pressure in the negative pressure zone.

Such devices to be effective require a proper seal about the negative pressure area or zone to prevent free entry of air into the zone such as would preclude the evacuation of the area and prevent development of the negative pressure. Numerous solutions have been proposed including flexible skirts which ride along and generally conform to the surface, rigid skirts with minimal clearance which, while not eliminating inflc w of air, will restrict the flow, and like means.

A problem with known devices is the leakage of air into the negative pressure zone beneath the surrounding skirt which leakage is normally related to the roughness of the surface and irregularities encountered thereon as the device moves thereacross. While the leakage may be minimal when using flexible skirts directly engaging a completely smooth surface, the leakage cannot be completely prevented, and rapidly increases in relation to an increased roughness of the surface. For example, it is unlikely that known devices of this type could effectively traverse a brick or tile wall or an acoustical tile ceiling which include major surface disruptions.

SUMMARY OF THE INVENTION

The mobile device or toy of the present invention includes a gravity-independent retention system which does not rely on a fixed or mechanical seal as an air excluding means as in the known art. Rather, a dynamic fluidic seal is provided in the nature of a radially outwardly directed primary forced air flow peripherally about a central defined area and generally parallel to the support or movement surface. A secondary air discharge from the central area is directed in an axial flow outward through the toy and away from the support surface generally perpendicular thereto to combine with the radial flow and produce the desired negative pressure zone.

The use of a dynamic fluid seal effectively precludes any peripheral ingress of air without regard, within limitations of course, to surface roughness or irregularities and has resulted in an effective sealing of peripheral spaces as wide as 0.125 inch to 0.190 inch in a toy vehicle utilizing impellers having a diameter of approximately four inches and a rotational speed of approximately 6000 RPM.

Basically, the vacuum generating and vehicle retention system utilizes a blade impeller having an axis of rotation perpendicular to the support surface. The impeller will preferably be axially aligned in an elongate sleeve having inner and outer ends, relative to the support surface, which extend slightly beyond the impeller inner and outer ends. The impeller has an overlying shroud plate over the outer end thereof. The sleeve in turn is peripherally spaced from the impeller and shroud plate to define an annular outwardly directed flow path through which a perpendicular thrust of the forced flow of air is discharged. A further flow of air, initially radially outwardly discharged from the impeller, flows inwardly along the inner surface of the sleeve and discharges circumferentially, i.e. radially, outwardly about the inner end of the sleeve to define the desired dynamic fluid seal about the inner end of the sleeve and between this inner end and the support surface. The physical engagement of the device with the support surface for travel therealong will normally be through a driven wheel assembly.

In the preferred embodiment, the invention contemplates a retention system wherein two separate impellers are utilized at longitudinally spaced points along the device or vehicle in the direction of travel, normally with a pair of wheels therebetween separately driven on a common transverse axis. So positioned the wheels allow for a pivoting of the vehicle relative to the support surface about the wheel axis, with a vacuum generating system to each side thereof, providing for an enhanced accommodation to surface irregularities or roughness, even under extreme circumstances wherein one or the other impellers might encounter a surface gap of sufficient extent to affect maintenance of the vacuum. In a variation, support skids can be provided on the front and rear of the vehicle, beyond the impellers, to limit pivoting.

The use of a single pair of wheels in itself is significant in that the impellers generate a substantially greater force thereon as opposed to the force which would be generated on the wheels of a more conventional four-wheeled vehicle. As such, there is a greater traction developed for movement of the vehicle regardless of the surface orientation. In connection therewith, it is contemplated that the single wheel axis, rather than being positioned exactly between the impellers, be offset to the rear of the vehicle as, in many circumstances, the greater weight will be toward the rear of the vehicle, whether this results from the power cord extending from the rear of the vehicle, or the natural tendency of the vehicle to pivot rearwardly as the vehicle moves up a vertical surface Also, the two wheels are to be separately driven as a means of steering the device as it traverses the support surface.

While the use of a flow-guiding sleeve about the impeller is preferred, it is also contemplated that, as a further embodiment, the vacuum-generating system not include the sleeve. In such an embodiment, the impeller, mounted on the vehicle, will be positioned closely adjacent the support surface, spaced therefrom a minimal distance to allow free travel of the vehicle without contact between the impeller and the surface and sufficient to define a zone or area to be evacuated.

With such an impeller, the discharging air flow is forcibly ejected radially outward and peripherally about the impeller to define an effective barrier, in the nature of a dynamic fluidic seal, which isolates the area inward of the impeller and precludes the entry of air into this area whereby the desired negative pressure is achieved and maintained. Such an arrangement, while less effective than the system incorporating an impeller-surrounding sleeve, will define the desired peripheral fluidic seal and will operate in the manner described to provide a zero-gravity system for a mobile toy.

As a further variation in the wheeled support system for the mobile device or toy, and in particular when a single impeller assembly is utilized, the vehicle chassis can mount on a pair of axially aligned rear drive wheels and a single pivotally mounted forward steering wheel.

Additional objects and advantages of the invention are considered to reside in the details of construction and manner of operation as will be more fully hereinafter described.

BRIEF DESCRIPTION OF THE DRAWINGS

FIG. 1 is an environmental illustration of the mobile toy of the invention travelling along a vertical surface;

FIG. 5 is a schematic view of the control system for

FIG. 6 is a detail view illustrating the air flow pattern for achieving the negative pressure zone with dynamic peripheral fluid seal;

DESCRIPTION OF PREFERRED EMBODIMENTS

Figure 2:
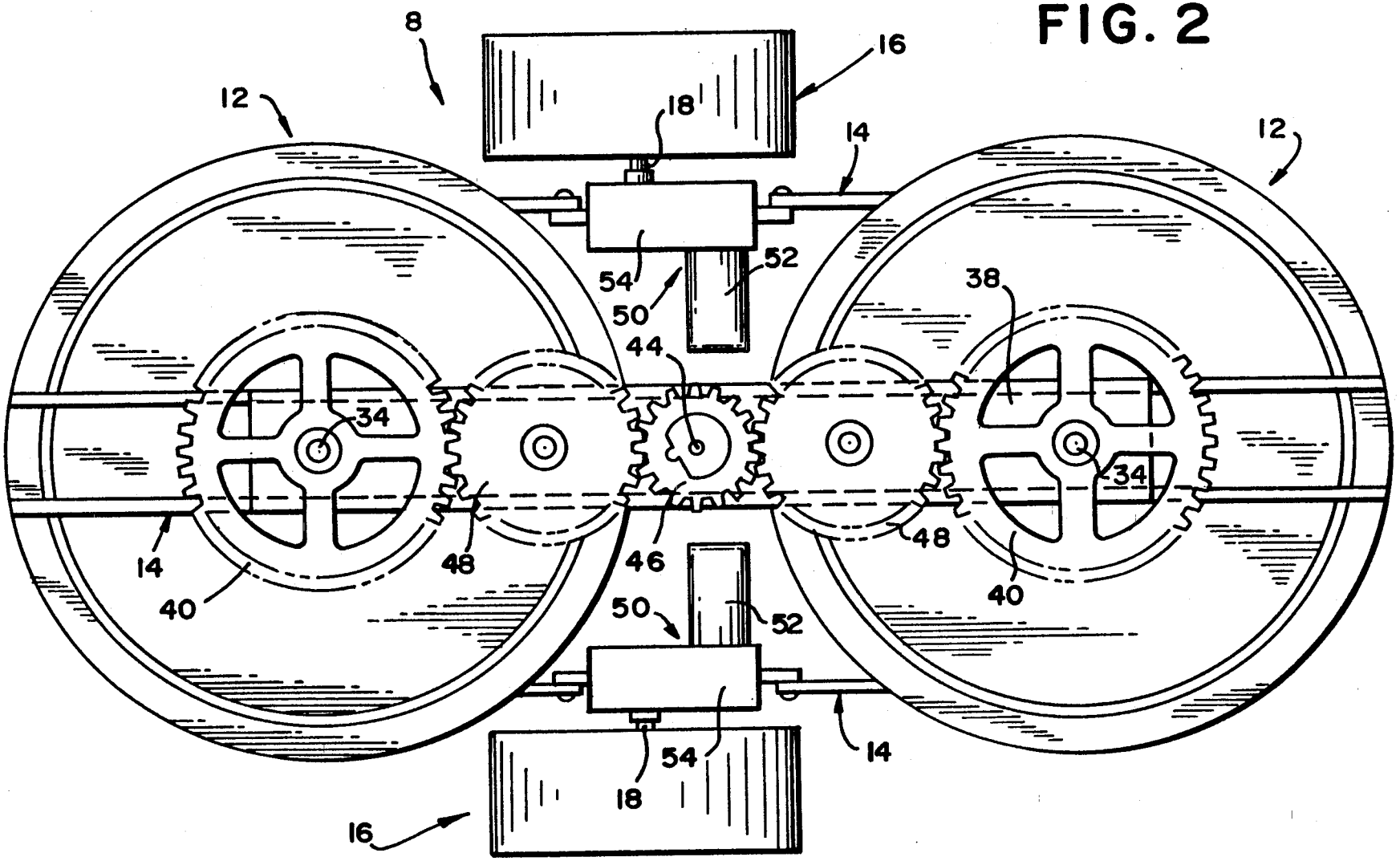
FIG. 2 is an enlarged top plan view of the mobile toy with the body removed for purposes of illustration.

Referring now more specifically to the drawings, the mobile device or toy 8, with an appropriate device-defining outer body or shell 10 as suggested in FIG. 1, is adapted to adhere to and travel along a movement surface 9 regardless of the orientation thereof, including vertically along a wall or in an inverted position across a ceiling. The outer body 1 has been removed in the various detail views for purposes of illustration.

In the preferred embodiment, the system for retaining the device to the surface 9 comprises forward and rear duplicate vacuum generating units 12 mounted to a framework or chassis 14 for the mobile toy 8. The framework 14 also mounts a single pair of laterally aligned duplicate traction wheels 16 on separate independently driven axles 18 on a common axis.

While not specifically detailed, the framework 14 will be of a rigid open construction sufficient to support the various operating components with minimal weight and air flow disruption. In a toy vehicle or the like, the chassis can be a molded plastic unit.

Each vacuum generating unit 12 comprises a cylindrical sleeve 18 formed of a thin imperforate peripheral wall. The sleeve includes opposed open ends, which, relative to a support surface 9 on which the device is to operate, comprises an inner or lower end 20 and an outer or upper end 22.

An impeller 24 is mounted coaxially within the sleeve 12 in inwardly spaced relation to the inner and outer ends thereof. The impeller is diametrically smaller than the sleeve 12 and rotatable therein to produce a forced air flow in a controlled manner through both ends of the sleeve 12 as will be described.

Figure 3:
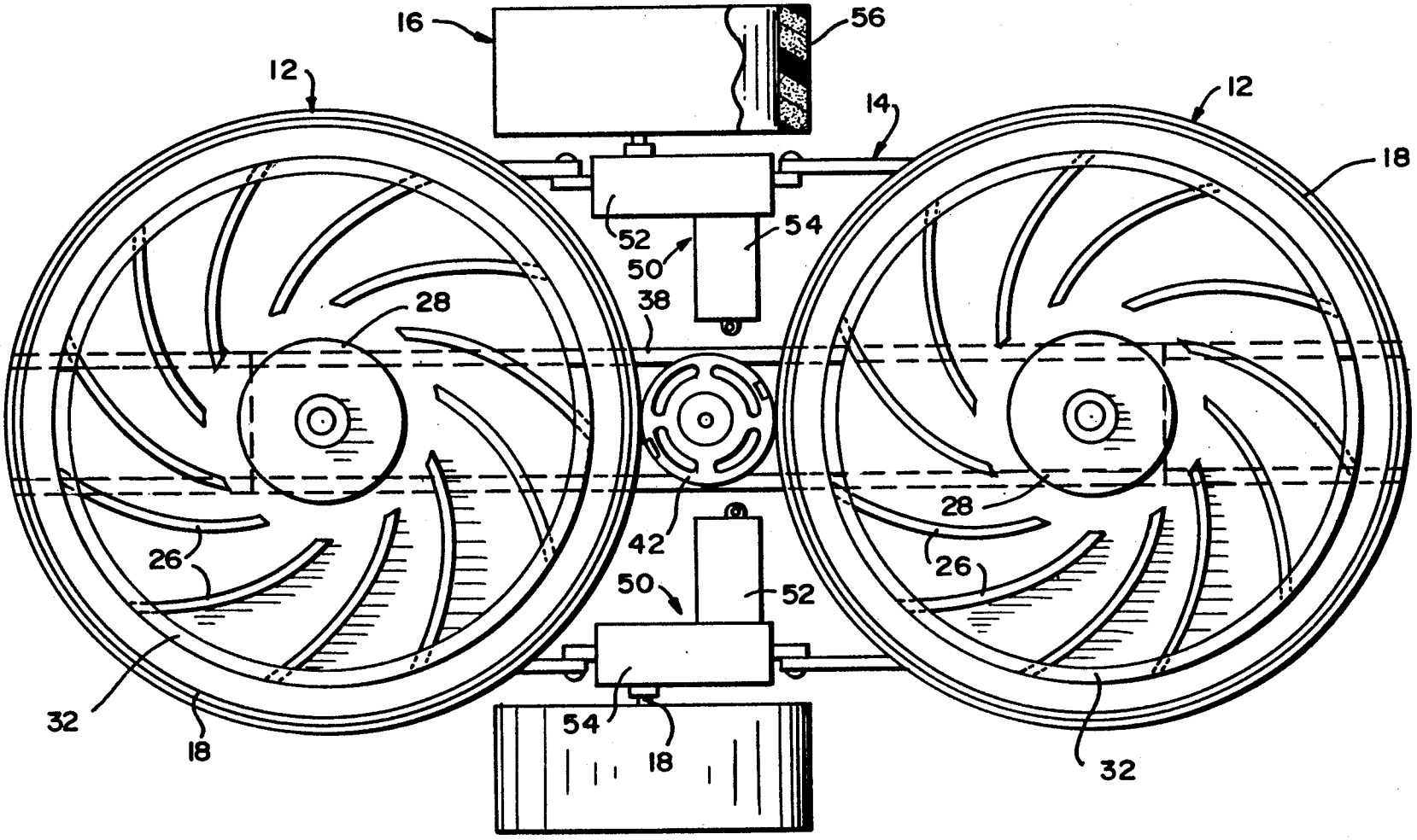
FIG. 3 is a bottom plan view of the mobile toy.

Structurally, the impeller 24 includes a plurality of blades 26 equally spaced about and radiating outwardly from a central hub 28 with each blade following a generally arcuate curvature from the root at the hub to the outer tip portion. The curvature and orientation of the blades 26 is such as to, upon a driving of the impeller 24, exhaust air from the area axially aligned with the impeller and between the impeller and the supporting surface 9 for lateral discharge toward the surrounding sleeve wall. The curvature of the impeller blades 26 decreases drag and reduce impeller motive power requirements as the impellers rotate with the convex faces of the blades 26 toward the direction of rotation. In other words, as viewed in the bottom plan view of FIG. 3, the impellers rotate counter-clockwise. The blades, as desired, need not have the curvature as shown.

An imperforate planar shroud plate 30 overlies and is affixed to the upper edges of the blades 26 coextensive therewith. The shroud plate 30 defines an annular passage 31 between the peripheral edge of the shroud plate and the surrounding sleeve slightly inward of the open outer end 22 of the sleeve. A flat annular ring 32 is affixed to the lower or inner edges of the impeller blades 26 at and immediately radially inward of the tip portions thereof. As desired, the blades can be slightly recessed to receive the ring 32.

An elongate impeller drive shaft 34 mounts the hub 28 and extends outward through the open outer end 22 of the sleeve 12 and through an appropriate journal assembly 36 in an overlying longitudinally extending central frame beam 38. The outer end of the shaft 34 mounts a driven impeller gear 40.

The two impellers 24, one within in each of the vacuum generating units or assemblies 12, are driven from a central electric impeller drive motor 42 vertically mounted to the supporting framework and including an outwardly directed drive shaft 44 journalled through the support beam 38 and mounting a drive gear 46 aligned centrally between the impeller gears 40 and in driving engagement therewith through a pair of pinion gears 48, one between the motor drive gear 46 and each of the impeller gears 40 to define a pair of oppositely directed aligned gear trains. As will be appreciated, the two impellers will be driven in the same rotational direction for simultaneously defining a pair of negative pressure areas toward the front and rear respectively of the mobile device. While the described gear train system is preferred, other drive trains, for example a belt and pulley arrangement, may also be used. In addition, it is conceivable that more than two vacuum generating units can be provided in a balanced relationship on the vehicle.

Mobility, that is the ability of the mobile toy to move across a surface, is achieved by the rotational driving of the single pair of opposed independently mounted wheels. Each wheel is driven by a separate self-contained motor assembly 50 including a variable speed, reversible drive motor 52 and a gear reduction unit 54 appropriately mounted to the supporting framework 14 and in turn mounting the wheel shaft 18.

The wheels 16 include resilient compressible foam rubber or plastic tires 56 for enhanced traction. The two wheel assemblies 16 are offset slightly to the rear of the transverse center line of the vehicle, that is closer to the rear vacuum generating assembly 12. Such a positioning has also been found to provide better traction and balance, particularly when traversing a vertical surface, in light of the inherent tendency of the vehicle to settle to the rear as the vehicle moves upward.

The independent mounting and driving of the wheel assemblies 16 is significant in providing for not only a selective forward and rearward driving of the device through the drive motors 52, but also for the steering of the mobile device through the expedient of driving the two wheels at different speeds, reversely driving one wheel assembly while forwardly driving the other wheel assembly, driving only one wheel assembly, etc.

The use of only two wheels is also considered desirable in that full support, drive and steering engagement with the surface is provided while at the same time maintaining the area of actual contact with the surface at a minimum whereby the full force of the pressure differential engaging the vehicle against the surface is concentrated at two points, the opposed wheels, for maximum traction. This traction, particularly through the use of foam material tires, improves with increased roughness of the support surface, within of course limits defined by the capability of the vacuum-generating assemblies to maintain areas of negative pressure. The use of two wheels also allows for a degree of "floating" of the forward and rear portions of the mobile device to enhance accommodation to surface irregularities.

Referring now specifically to FIG. 6, the inner or lower edge 58 of the sleeve 12, which defines the open inner end 20 of the sleeve, is spaced slightly below the inner or lower side of the impeller 24 and defines a peripheral lip which, when positioned parallel to the support surface, floor, wall, ceiling or the like, is spaced therefrom, by the peripheries of the wheels engaging the surface. The spacing will of course vary to a degree based on the nature or roughness of the support surface 9 and the compressibility of the foam tires 56.

As each impeller is rotatably driven, a forced air flow 60 is effected outwardly from a central defined area 62 between the inner end of the impeller and the support surface to create an area of negative pressure. The forced air flow 60 is, through the surrounding sleeve 18, divided into two distinct flow paths. An annular flow path 64 axially discharges approximately 20% to 30% of the forced air flow 60 outward through the open outer end 22 of the sleeve 18 between the sleeve 18 and the outer periphery of the imperforate shroud plate 30, and generally perpendicular to the support surface.

The second, and principal, flow path 66 is defined circumferentially about the negative pressure area 62 and between the support surface 9 and the lower lip or peripheral edge 58 of the sleeve 18. The flow of forced air 60, guided along the surface of the peripheral wall of the sleeve 18, has a major portion thereof, approximately 70% to 80%, diverted axially inward toward the support surface and radially outward between the sleeve 18 and support surface to define a dynamic fluid seal which effectively precludes any inward movement of air as would disrupt the vacuum effect in the negative pressure area 62. This seal is effected without the conventional use of flexible sealing skirts or the like, and allows for an effective accommodation of surface irregularities or roughness, as for example might be encountered in an acoustical tile ceiling or even in a finished brick wall, both of which can be easily traversed by the device of the invention.

While it is clear that the mobile device will operate as described and that the two distinct flow paths are developed, that is an axial thrust flow path, and more importantly the seal-defining circumferential flow path, no specific theory of operation has been developed. It is believed that the desired results, and in particular the fluidic seal, may be achieved by a positioning of each impeller closely adjacent the support surface with the lower edges of the blades 26 thereof being positioned a minor distance above the support surface. In this manner, surface clearance is provided for rotational driving of the impeller and a significant radial discharge, defining the fluidic seal, is achieved without any tendency for the radial air flow to reverse within the sleeve and recirculate through the negative pressure area and the impeller. This positive outward directing of the air flow might also be enhanced by the blade-stabilizing ring 32.

Figure 5:
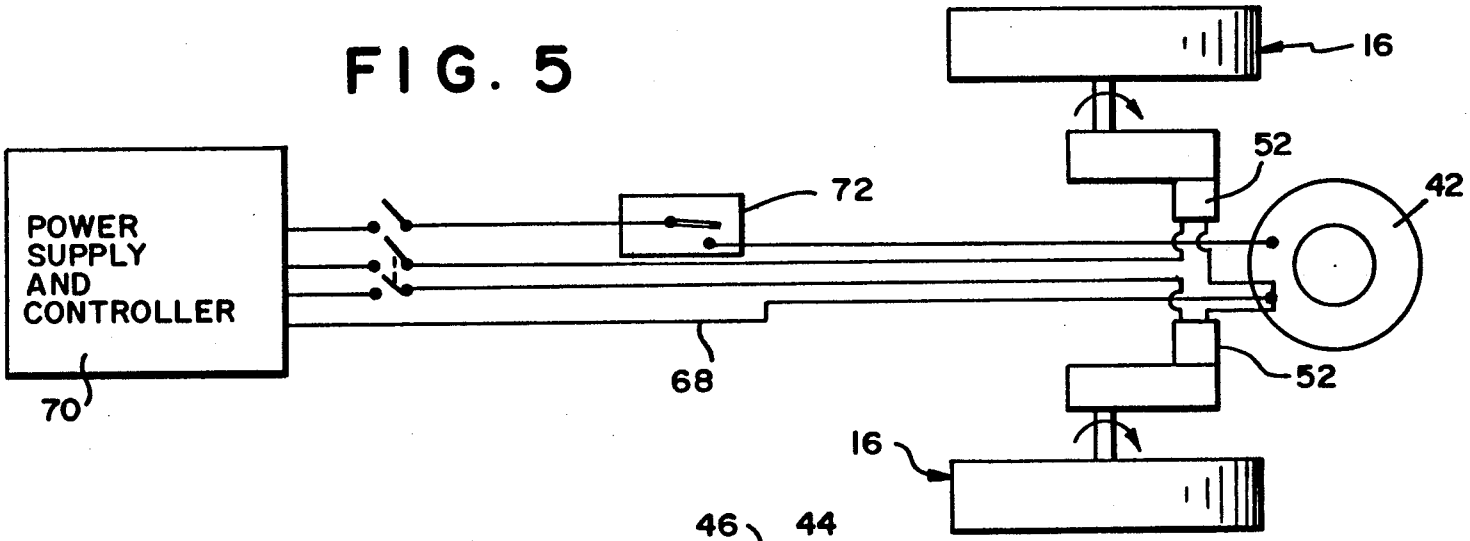
Figure 4:
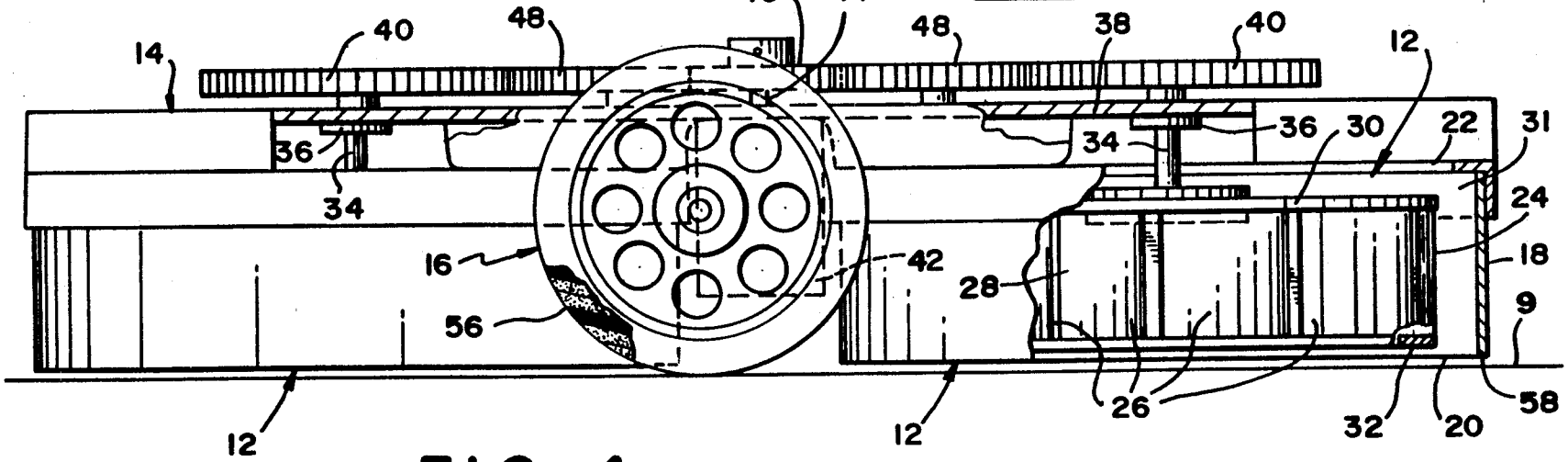
FIG. 4 is a side elevational view of the toy with portions broken away for purposes of illustration.

Noting FIGS. 1 and 5, the mobile device 8 will preferably be remotely operated with an elongate combined tether and power cord 68 extending from the device motors 42 and 52 to a remote power supply and controller 70. While the power supply can be line power with an appropriate transformer, for maximum mobility a battery pack would be preferred. A radio link control system may also be used.

The controller, as suggested in FIG. 5, will include appropriate switch means for activation of the drive motor 42 for the two impellers, and for the selective and directional activation of the two individual wheel drive motors 52 for the propelling and steering of the mobile device. As desired, an appropriate cut-off switch 72 can be provided on the vehicle itself. It is also contemplated that the vehicle be provided with a contact switch which engaged the support surface for an automatic activation of the impeller drive system upon a positioning of the vehicle on the surface, and an automatic deactivation upon removal from the surface.

Figure 7:
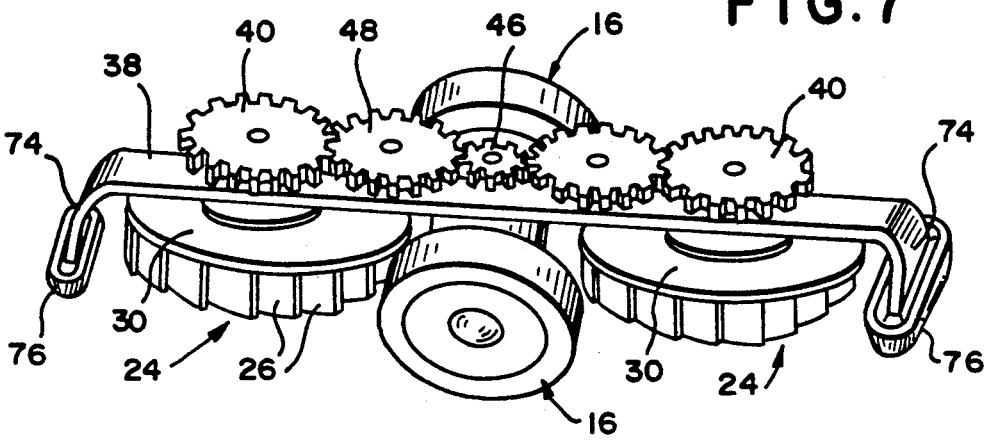
FIG. 7 is a perspective view of a second embodiment wherein the vacuum-generating units are provided without surrounding air flow guide sleeves.

Referring to FIG. 7, a further embodiment of the mobile toy is presented therein and illustrates two features which differ from the first disclosed embodiment. Those features which are the same as previously described with regard to the first embodiment have been designated by like reference numerals. In regard thereto, it will be noted that, in this embodiment, the front and rear impellers 24 are mounted to the central frame beam 38 and are driven from a central drive motor and drive gear 46 by means of a pair of oppositely directed aligned gear trains 40, 48. The assembly is supported and made mobile by a pair of centrally positioned and transversely aligned traction wheels 16.

The central frame beam 38 includes downturned forward and rear end portions 74, each terminating in a transverse skid 76 presents a surface-engaging lower face convexly arced about an axis transverse to the vehicle and the direction of travel for a smooth riding thereof along the surface regardless of whether the vehicle is moving forward or rearward. The skids provide an additional degree of front-to-rear stability against any tendency of the vehicle to pivot excessively about the wheel axis. The arcuate configuration of the skids 76 provide for minimal contact with the support surface and thus the skids do not constitute any restriction to movement the mobile toy or vehicle. Further, the transverse length of the skids 76 is only a minor portion of the width of the vehicle with the transverse ends also being of a generally convex configuration to accommodate a turning of the vehicle, again with minimal interference. The skids 76 can be of a height, or depend from the frame 48, sufficient to simultaneously engage the support surface with the drive wheels 16. Alternatively, the skids can be slightly elevated for engagement in response to a slight pivoting about the drive wheels.

Figure 8:
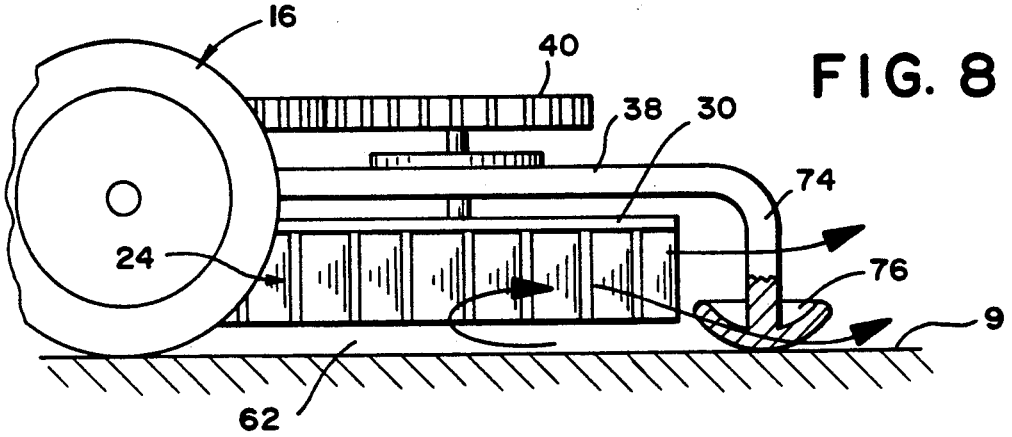
FIG. 8 is an elevational detail of the embodiment of FIG. 7.

FIG. 7 also illustrates another variation wherein the impellers 24 are provided without a surrounding sleeve such as the sleeve 18 in the first embodiment. As such, the discharging air flow from each impeller, as suggested in FIG. 8, discharges radially outward from the impeller below the shroud plate 30 affixed to the upper or outer edges of the impeller blades 26. This air flow discharge will be radially outward circumferentially around each impeller 24 and, because of the overlying shroud plate 30 and the close proximity of the impeller to the support surface 9, will tend to sweep along the surface peripherally about the zone or area 62 centrally under each impeller and within which the desired negative pressure or vacuum is to be generated.

The radial outwardly directed air flow thus produced provides an effective dynamic fluidic seal which, while not as effective as that achieved in the first embodiment with the peripheral sleeve, does enable the maintenance of a negative pressure zone sufficient to provide a device operative in the manner described with the first embodiment. Basically, inasmuch as the only air flow generated by the impeller is outward from the negative pressure zone, and as this outward flow effectively precludes any possibility of a reverse or inflow of air, particularly about the inner or axial intake of the impeller, the desired result is achieved. It will also be recognized that the front and rear skids 76 prevent contact of the driven impellers 24 with the support surface regardless of the pivotal forward-to-rear adjustment of the vehicle.

Figure 9:
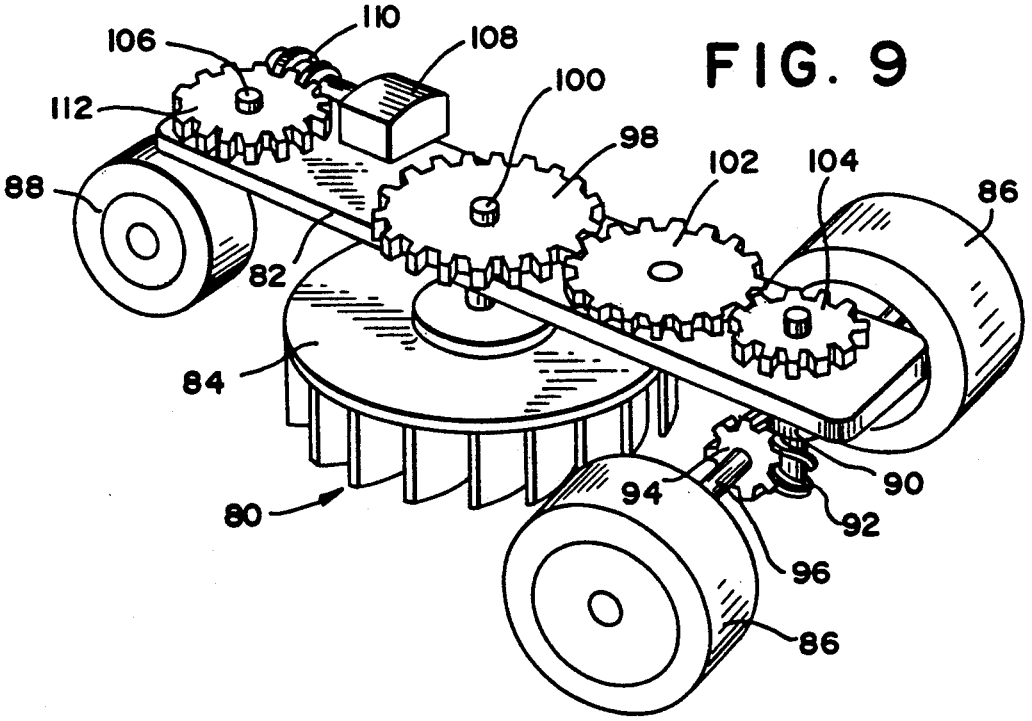
FIG. 9 is a perspective view of a further embodiment utilizing a single vacuum-generating impeller.

Further contemplated variations are illustrated in conjunction with the embodiment of FIG. 9. In this embodiment, the mobile device or toy vehicle includes a single impeller 80 generally centrally mounted to and depending from a front-to-rear extending chassis support beam 82.

The impeller 80 includes an axially outer shroud plate 84 as in the manner of a previously described shroud plates. In addition, the impeller 80, with the lower or inner face thereof spaced closely adjacent the support surface, can be provided with a surrounding sleeve (not illustrated) in the same cooperative relationship as illustrated between the sleeve and impeller in FIG. 6, or can be utilized without a sleeve in the manner of the showing in FIG. 8.

The vehicle is supported by a pair of laterally aligned rear drive wheels 86 and a centrally positioned front steering wheel 88. The wheels are of a size, relative to the chassis supported thereby, to maintain the impeller in substantially parallel and closely spaced adjacent relation to the support surface upon which the device is to travel in order to achieve, in the manners previously described, the desired negative pressure zone. In regard thereto, and as previously noted, the provision of the surrounding sleeve allows for a more effective development of the vehicle-retaining vacuum and dynamic fluidic seal.

The driving of the rear drive wheels and the impeller is effected by a single rear drive motor 90 in driving engagement with both the drive wheels and impeller through separate gear trains. As an example, the motor 90 can be provided with a downwardly directed, relative to the support surface, shaft component mounting a worm gear 92 in driving engagement with a spur gear 94 attached to a common axle 96 for the drive wheels 86. The gear train for the impeller 80 can consist of a gear reduction assembly of edge-meshing progressively smaller gears including an enlarged gear 98 affixed to the impeller shaft 100, at least one spur gear 102 and a motor mounted drive gear 104. While drive trains as described are preferred, other drive means, for example drive belts and pulleys, may also be used.

The front steering wheel 88 mounts to a vertical shaft 166 which is rotatably controlled by means of a separate motor 108 having a driven worm gear 110 thereon meshing with a spur gear 112 affixed to the steering wheel shaft 106. Both motors 90 and 108 are adapted for remote control in any appropriate manner, and the control system can include such of the previously described features as desired. For example, the vehicle of the embodiment of FIG. 9 can be provided with a contact switch for automatic activation of the drive system upon a positioning of the vehicle on the support surface, and an automatic deactivation upon removal from the support surface, The foregoing is considered illustrative of the principals of the invention. Such other embodiments and variations as may occur to those skilled in the art are to be considered within the scope of the invention as claimed.

I claim:

1. A mobile toy adapted to be retained against and move along a movement surface, said toy including a gravity-independent retention system for adherence of said toy to the surface, said toy comprising outer and inner sides relative to the movement surface and including inwardly extending support means engageable with the surface for support of the toy thereon and for movement of the toy therealong, and means for propelling said toy along the surface, said retention system including vacuum generating means which in turn includes means for producing a forced fluid flow outwardly away from a central defined area immediately inward of said toy to create an area of negative pressure at the surface, said support means extending inwardly beyond said vacuum generating means for positioning said vacuum generating means in closely spaced relation to the movement surface, said vacuum generating means further including guide means for directing said forced fluid flow along two flow paths, a first flow path outwardly directed through said toy and discharging to said outer side thereof away from the defined area, and a second flow path circumferentially about said defined area and radially outwardly directed relative to said central defined area at the movement surface to form a dynamic fluid seal at said inner side of said toy about said central defined area restricting an inflow of fluid to said central defined area.

2. The mobile toy of claim 1 wherein said guide means includes sleeve means peripherally surrounding said vacuum generating means, said sleeve means having an outer end portion and an inner end portion, and an outer plate means overlying said vacuum generating means at said outer end portion of said sleeve means, said plate means being radially inwardly spaced from said sleeve and forming a passage outwardly directed from said sleeve means peripherally about said outer plate means to define said first flow path.

3. The mobile toy of claim 2 wherein said inner end portion of said sleeve means is open inward of said toy and includes a peripheral inner edge forming a passage peripherally about said sleeve means between said sleeve means and the movement surface and radially outward from said vacuum generating means to define said second flow path inward of and radially beneath said inner edge.

4. The mobile toy of claim 3 wherein said vacuum generating means comprises an impeller with an axial intake opening to said inner side of said toy, and a circumferential radial discharge, said impeller including a central hub area with radial blades projecting therefrom and terminating in outer tip portions, said blades having upper and lower edges with the lower edges disposed adjacent the movement surface and the upper edges disposed outward thereof, said outer plate means being affixed to said upper blade edges.

5. The mobile toy of claim 4 including an annular ring fixed to said blade lower edges at and immediately adjacent said blade tip portions, said annular ring having a radial width comprising only a minor portion of the length of the lower edges of said blades.

6. The mobile toy of claim 4 wherein said toy has a front end and a rear end designating a general direction of travel, said retention system comprising at least a second vacuum generating means including an impeller and substantially duplicating said first-mentioned vacuum generating means, said first and second vacuum generating means being mounted, respectively, toward the front and rear ends of said mobile toy.

7. The mobile toy of claim 6 including drive means for simultaneously driving said impellers, said drive means comprising motor means and a power train extending from said motor means to each of said impellers.

8. The mobile toy of claim 7 wherein said power train comprises a drive gear shaft-mounted to said motor means, a separate shaft-mounted driven gear mounted to each impeller, and a spur gear between said motor gear and each driven gear.

9. The mobile toy of claim 8 wherein said inwardly extending support means comprises a single pair of support wheels aligned transversely across said toy between said first and second vacuum generating means.

10. The mobile toy of claim 9 wherein said pair of wheels are aligned on a transverse axis offset slightly rearward of the center line of the mobile toy.

11. The mobile toy of claim 10 wherein each of said wheels is independently driven.

12. The mobile toy of claim 11 wherein each of said wheels is provided with an outer layer of traction-enhancing compressible material.

13. The mobile toy of claim 1 wherein said toy has a front end and a rear end designating a general direction of travel, said retention system comprising a second vacuum generating means substantially duplicating said first-mentioned vacuum generating means, said first and second vacuum generating means being mounted, respectively, toward the front and rear ends of said mobile toy.

14. The mobile toy of claim 13 including drive means for simultaneously driving both said vacuum generating means, said drive means comprising motor means and a power train extending from said motor means to each of said vacuum generating means.

15. The mobile toy of claim 14 wherein said surface-engageable support means comprises a single pair of support wheels aligned transversely across said toy between said first and second vacuum generating means.

16. The mobile toy of claim 15 wherein said pair of wheels are aligned on a transverse axis offset slightly rearward of the center of the mobile toy.

17. The mobile toy of claim 16 wherein each of said wheels is independently driven.

18. A mobile toy adapted to be retained against and move along a movement surface, said toy including a gravity-ingredient retention system for adherence of said toy to the surface, said toy comprising outer and inner sides relative to the movement surface and including inwardly extending support means engageable with the surface for support of the toy thereon and for movement of the toy therealong, and means for propelling said toy along the surface, said retention system including vacuum generating means which in turn includes means for producing a forced fluid flow radially outwardly directed circumferentially about and away from a central defined area immediately inward of said toy and generally along the surface to create an area of negative pressure at the surface, and guide means for directing said forced fluid flow along a flow path radially outwardly directed relative to said central defined area at the movement surface to form a dynamic fluid seal at said inner side of said toy about said central defined area restricting an inflow of fluid to said central defined area, said vacuum generating means further including fluid guide means for directing at least a portion of said forced fluid flow outward through said toy and away from said movement surface said support means extending inwardly beyond said vacuum generating means for positioning said vacuum generating means in closely spaced relation to the movement surface.

19. The mobile toy of claim 18 wherein said fluid guide directs said outward fluid flow generally perpendicular to the surface.

20. The mobile toy of claim 19 wherein said vacuum-generating means comprises an impeller with an axial intake opening to said inner side of said toy, and a circumferential radial discharge, said impeller including a central hub area with radial blades projecting therefrom and terminating in outer tip portions, said blades having upper and lower edges with the lower edges disposed adjacent the movement surface and the upper edges disposed outward thereof, said guide means comprising outer shroud plate means affixed to said upper blade edges.

21. The mobile toy of claim 1 wherein said toy has a front end and a rear end designating a general direction of travel, said retention system comprising at least a second vacuum generating means including an impeller and substantially duplicating said first-mentioned vacuum generating means, said first and second vacuum generating means being mounted, respectively, toward the front and rear ends of said mobile toy.

22. The mobile toy of claim 1 wherein said inwardly extending support means comprises a single pair of support wheels aligned transversely across said toy between said first and second vacuum generating means.

23. The mobile toy of claim 22 wherein said support means further includes surface engaging skids at the front and rear ends of the toy for maintaining both impellers in spaced relation to the surface.

24. The mobile toy of claim 1 wherein said toy has a front end and a rear end designated a general direction of travel, said support means comprises a pair of drive wheels aligned transversely across said toy adjacent the rear end thereof and rearward of said impeller, and a steering wheel forward of said impeller, first motor means for driving said drive wheels and second motor means for rotatably steering said steering wheel.

25. The mobile toy of claim 24 including a drive train between said first motor means and said impeller for a driving of said impeller by said first motor means.

* * * * *

UNITED STATES PATENT AND TRADEMARK OFFICE

CERTIFICATE OF CORRECTION

PATENT NO. : 5,194,032

DATED : March 16, 1993

INVENTOR(S) : Henry A. Garfinkel

It is certified that error appears in the above-identified patent and that said Letters Patent is hereby corrected as shown below:

Column 10, line 39, after "guide" insert --means--.

Column 10, line 52, "claim 1" should be --claim 20--.

Column 10, line 60, "claim 1" should be --claim 21--.

Column 11, line 1, "claim 1" should be --claim 20--.

Signed and Sealed this

Sixteenth Day of November, 1993

*Attest:*

Bruce Lehman

BRUCE LEHMAN

*Attesting Officer*

*Commissioner of Patents and Trademarks*